US010720287B2

(12) United States Patent
Levay et al.

(10) Patent No.: US 10,720,287 B2
(45) Date of Patent: Jul. 21, 2020

(54) CONTROL PANEL PUSH BUTTON

(71) Applicant: DENSO International America, Inc., Southfield, MI (US)

(72) Inventors: Christopher Levay, Grand Rapids, MI (US); Spenser Pawlik, Clarkston, MI (US); Javon Tucker, Southfield, MI (US); Murali Daruri, Troy, MI (US); Jesse Moellers, Royal Oak, MI (US); Yuki Matsumoto, West Bloomfield, MI (US); Brian Steele, Grand Blanc, MI (US)

(73) Assignee: DENSO International America, Inc., Southfield, MI (US)

( * ) Notice: Subject to any disclaimer, the term of this patent is extended or adjusted under 35 U.S.C. 154(b) by 0 days.

(21) Appl. No.: 16/006,171

(22) Filed: Jun. 12, 2018

(65) Prior Publication Data

US 2019/0378665 A1 Dec. 12, 2019

(51) Int. Cl.
*H01H 13/02* (2006.01)
*H01H 11/00* (2006.01)

(52) U.S. Cl.
CPC ..... *H01H 13/023* (2013.01); *H01H 11/00* (2013.01); *H01H 2013/026* (2013.01); *H01H 2219/036* (2013.01); *H01H 2219/06* (2013.01); *H01H 2219/062* (2013.01); *H01H 2229/044* (2013.01)

(58) Field of Classification Search
CPC ..... H01H 13/023; H01H 11/00; H01H 2013/026; H01H 13/83; Y10T 29/49105
USPC ..... 200/310–314, 317
See application file for complete search history.

(56) References Cited

U.S. PATENT DOCUMENTS

| | | | | |
|---|---|---|---|---|
| 6,737,596 B1 * | 5/2004 | Hein | H01H 13/702 | 200/310 |
| 2006/0209518 A1 * | 9/2006 | Nishimoto | H01H 19/025 | 361/760 |
| 2009/0166163 A1 * | 7/2009 | Moro | H01H 13/023 | 200/314 |

FOREIGN PATENT DOCUMENTS

| | | | |
|---|---|---|---|
| JP | 2006260812 A | 9/2006 | |
| JP | 2006260813 A | 9/2006 | |
| JP | 2006269286 | * 10/2006 | H01H 13/14 |
| JP | 2006269286 A | 10/2006 | |
| JP | 2006269287 A | 10/2006 | |

* cited by examiner

*Primary Examiner* — Edwin A. Leon
*Assistant Examiner* — Iman Malakooti
(74) *Attorney, Agent, or Firm* — Harness, Dickey & Pierce, P.L.C.

(57) ABSTRACT

A push button for a control panel. The push button includes a button body and a reflector molded as a single, monolithic piece with links extending between the button body and the reflector. A divider of the button body is between a first light source of a printed circuit board and an indicator light guide of the button body. The divider restricts light from the first light source from illuminating the indicator light guide.

20 Claims, 4 Drawing Sheets

CONTROL PANEL PUSH BUTTON

FIELD

The present disclosure relates to a control panel push button.

BACKGROUND

This section provides background information related to the present disclosure, which is not necessarily prior art.

Control panels, such as automobile instrument control panels, are often manufactured by injection molding. Typically, a two-shot molding or two-piece design is used. While current push buttons are suitable for their intended use, they are subject to improvement.

For example and with reference to FIG. 1, a prior art push button is illustrated at reference numeral 110. The push button 110 includes a reflector 112 mounted to a circuit board 114. The circuit board 114 includes a graphic LED 116 and an indicator LED 118. Coupled to the reflector 112 is a button cap 130. Seated within the button cap 130 is an indicator light guide 132. An indicator portion 134 of the indicator light guide 132 is at an exterior surface of the button cap 130. The indicator light guide 132 and the indicator 134 are illuminated by the indicator LED 118. The graphic LED 116 illuminates a graphic at the exterior surface of the button cap 130. The graphic is generally aligned with the graphic LED 116, and spaced apart from the indicator 134. The graphic is any graphic suitable to convey the operation of the push button 110, such as an HVAC setting icon. The circuit board 114 further includes a tact switch or rubber switch mat (not shown) that is actuated when the push button 110 is depressed.

While such prior art push buttons 110 are suitable for their intended use, they are subject to improvement. Specifically, in some instances light from the graphic LED 116 may pass over the reflector 112 and illuminate the indicator light guide 132 (see arrows in FIG. 1 representing this light "leak"). The indicator 134 may thus become partially illuminated even when the push button 110 has not been depressed and the function controlled by the push button 110 is not active. This illumination of the indicator 134 will provide the user with a false notification. The present disclosure addresses this issue in the art, as well as numerous others, as explained in detail herein and as one skilled in the art will appreciate.

SUMMARY

This section provides a general summary of the disclosure, and is not a comprehensive disclosure of its full scope or all of its features.

The present disclosure provides for a push button for a control panel. The push button includes a button body and a reflector molded as a single, monolithic piece with links extending between the button body and the reflector. A divider of the button body is between a first light source of a printed circuit board and an indicator light guide of the button body. The divider restricts light from the first light source from illuminating the indicator light guide.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

and

Figure 7:
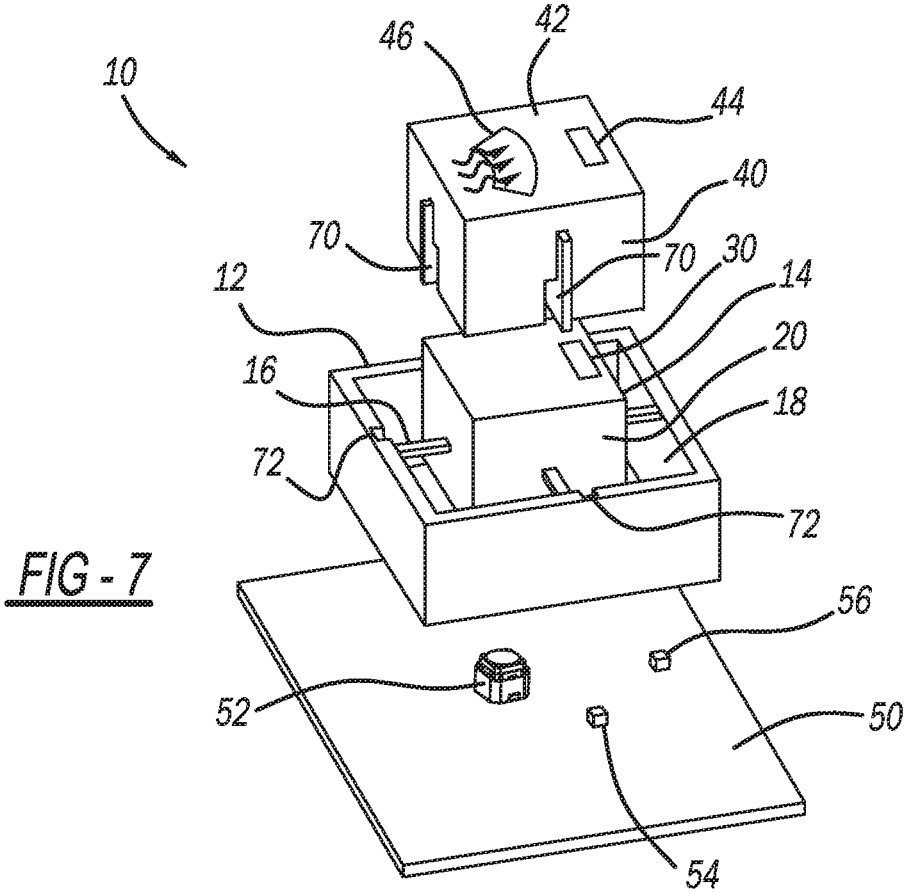

FIG. 7 is a perspective view of another push button in accordance with the present disclosure.

Corresponding reference numerals indicate corresponding parts throughout the several views of the drawings.

DETAILED DESCRIPTION

Example embodiments will now be described more fully with reference to the accompanying drawings.

Figure 1:
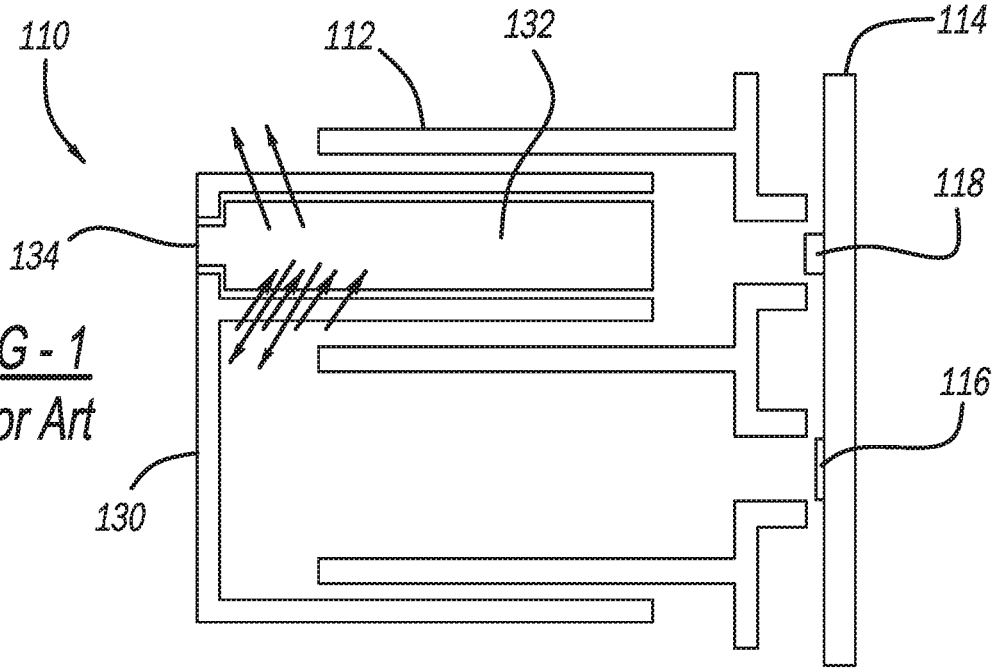
FIG - 1 Prior Art
FIG. 1 is a cross-sectional view of a prior art push button.
Figure 2:
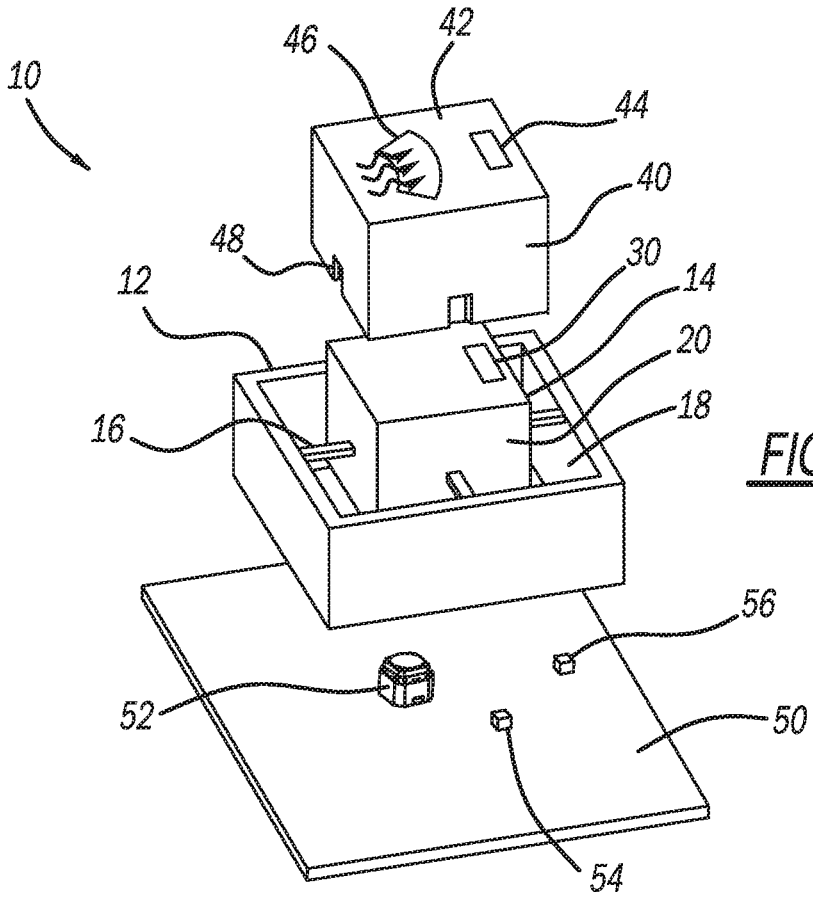
FIG. 2 is an exploded perspective view of a push button in accordance with the present disclosure.

With initial reference to FIG. 2, a push button in accordance with the present disclosure is illustrated at reference numeral 10. The push button 10 can be configured for use with any suitable control panel to control features of any system associated therewith. For example, the push button 10 may be included with a control panel of a vehicle instrument panel to control features thereof, such as features related to operation of an heating, ventilation, and air conditioning (HVAC) system.

The push button 10 generally includes a reflector 12 and a button body/slider 14. The button body 14 is connected to the reflector 12 by way of links 16. The reflector 12 has reflector walls 18, and the button body 14 has sidewalls 20. The links 16 extend between the reflector walls 18 and the sidewalls 20.

The reflector 12, button body/slider 14, and links 16 together provide a button body/reflector assembly, which is molded as a single, monolithic piece using any suitable one-shot molding process. Exemplary one-shot molding processes include injection compression molding and any suitable conventional molding process, as explained in detail herein. The links 16 provide bridges or passageways for the molding material, such as any suitable polymeric material, to flow from the portion to be formed as the reflector 12 to the portion to be formed as the button body/slider 14.

Figure 3:
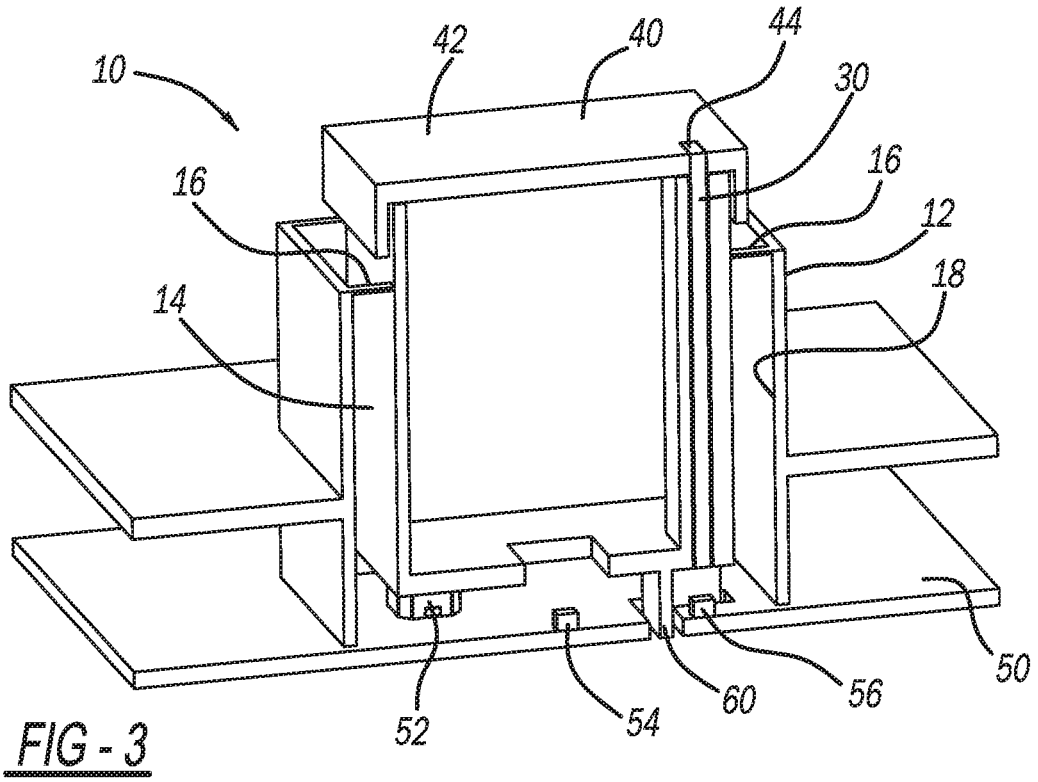
FIG. 3 is a cross-sectional view of the push button of FIG. 2.

Seated within the button body 14 is an indicator light guide 30 (see FIG. 3, for example). A button cap 40 includes an outer surface 42, which defines an aperture 44. The button cap 40 is arranged on the button body 14 such that the aperture 44 aligns with the indicator light guide 30. The button cap outer surface 42 further includes a graphic 46, which can be any suitable graphic/icon identifying the operating feature that the push button 10 controls. For example and as illustrated in FIG. 2, the graphic 46 may be a defrost graphic. The button cap 40 defines recesses 48, which accommodate the links 16 when the button cap 40 is seated on the button body 14.

The reflector 12 is mounted to a printed circuit board 50 in any suitable manner. The printed circuit board 50 includes a tact switch 52, a first light source 54 (or graphic light source), and a second light source 56 (or indicator light source). The tact switch 52 may be any suitable switch or other member, which when actuated in response to the button body 14 being depressed will activate or deactivate the function controlled by the push button 10. The light sources 54 and 56 may be any suitable light sources, such as light emitting diodes (LEDs).

With specific reference to FIG. 3, the reflector 12 and the button body 14 are mounted to the printed circuit board 50 such that the first light source 54 is opposite to, and generally aligned with, the graphic 46 in order to illuminate the graphic 46. The indicator light source 56 is aligned with the indicator light guide 30 to illuminate the indicator light guide 30. The button body 14 further includes a divider 60, which is between the light sources 54 and 56. The divider 60 is not transparent, and thus the divider 60 prevents light generated by the light source 54 from passing to the indicator light guide 30 and illuminating the indicator light guide 30, and vice versa.

Figure 4A:
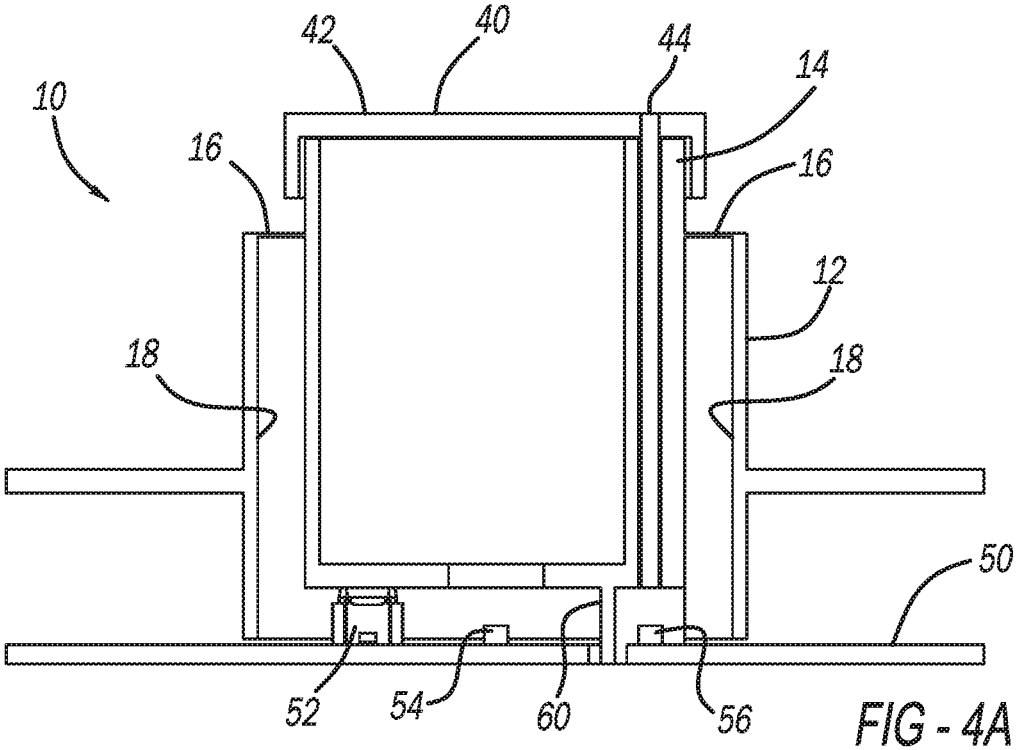
FIG. 4A is a cross-sectional view of a push button in accordance with the present disclosure in a non-depressed state.
Figure 4B:
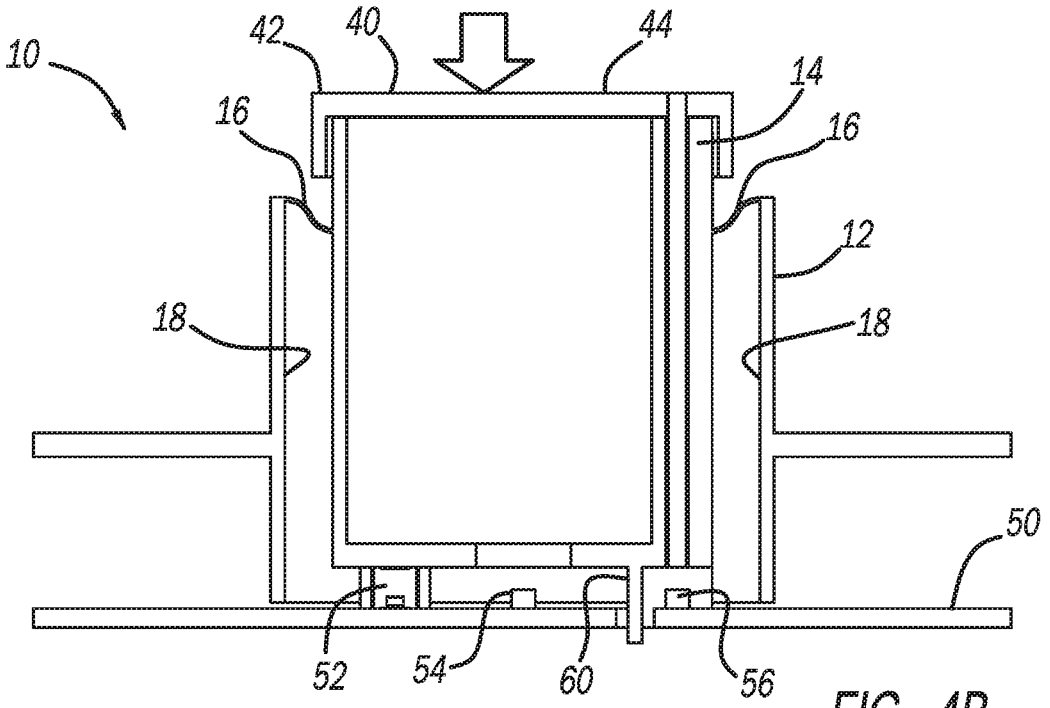
FIG. 4B is similar to FIG. 4A, but with the push button in a depressed state.
Figure 5:
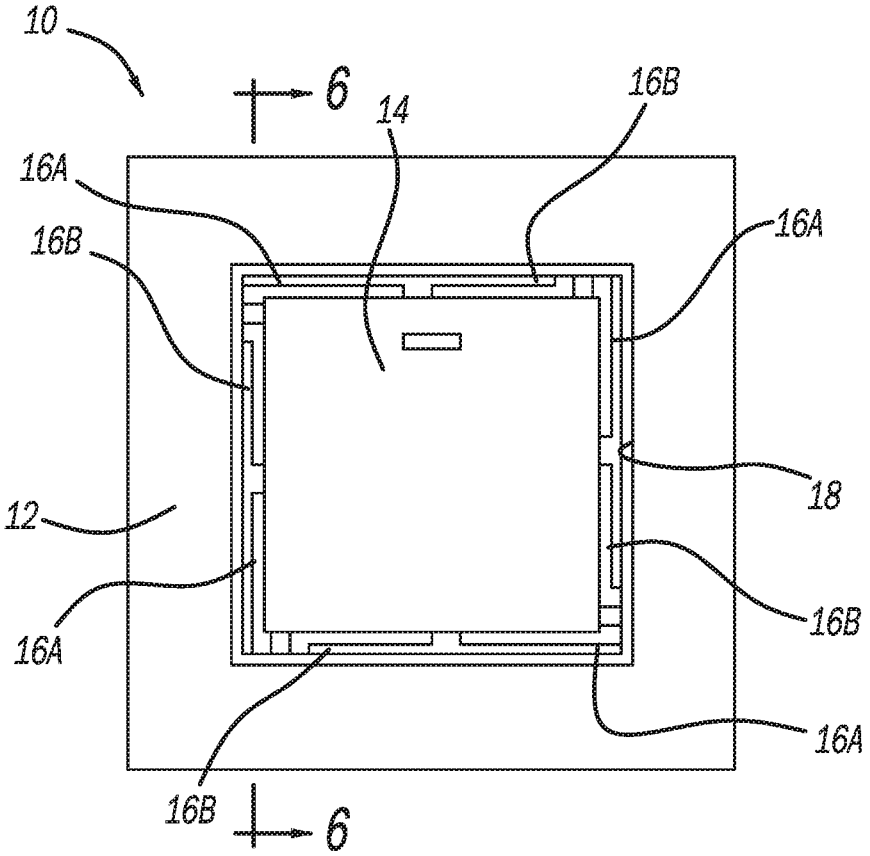
FIG. 5 is a planar view of another push button in accordance with the present disclosure.
Figure 6:
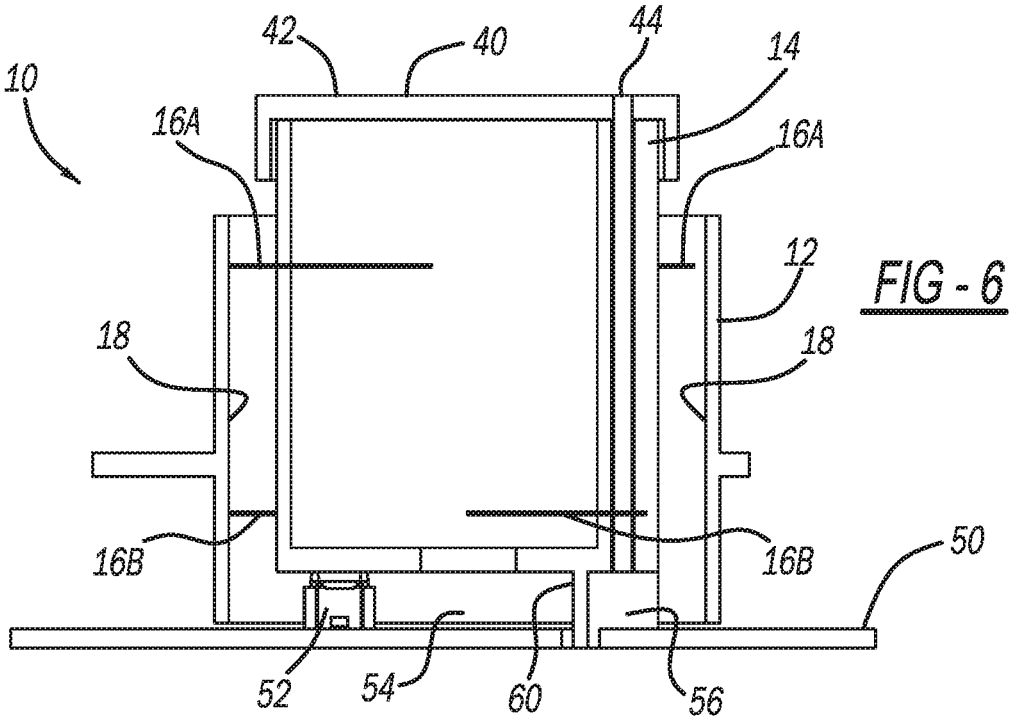
FIG. 6 is a cross-sectional view taken along line 6-6 of FIG. 5.

With additional reference to FIGS. 4A and 4B, the links 16 can be formed as thin flexible plastic strips, such as by injection compression molding of the reflector 12, button body 14, and links 16. Thus when the button body 14 is depressed from the relaxed (undepressed) state of FIG. 4A to the depressed/actuated state of FIG. 4B to trigger the tact switch 52, the links 16 will flex. The links 16 advantageously center the button body 14 within the reflector walls 18. The links 16 may extend linearly between the reflector walls 18 and the button body 14 (see FIGS. 2, 3, 4A, and 4B) or non-linearly, as illustrated in FIGS. 5 and 6. The non-linear links 16A and 16B can be made longer than the linear links 16, thus advantageously making it easier to flex the links 16A and 16B, and easier to depress the button body 14. To reduce any "wobble" of the button body 14 within the reflector 12, two layers of links 16A and 16B can be provided. Specifically, and as illustrated in FIG. 6, an upper layer of links 16A and a lower layer of links 16B are included. The upper links 16A are vertically offset from the lower links 16B. The upper links 16A do not overlap the lower links 16B, so as to allow molding feasibility.

With additional reference to FIG. 7, the button body 14 may be molded with guiderails 70 protruding from the sidewalls 40 thereof. The guiderails 70 are seated within guiderail receptacles 72 defined within the reflector walls 18. The guiderails 70 advantageously maintain the button body 14 centered within the reflector 12. In some applications, the links 16 may be molded as rigid plastic resin bridges by any suitable conventional molding process. Subsequent to molding, the rigid links 16 are cut or otherwise severed. In such applications, the guide rails 70 advantageously maintain the button body 14 centered within the reflector 12.

The present disclosure thus advantageously provides for a push button 10 that restricts light from the graphic light source 54 from illuminating the indicator light guide 30. This prevents the indicator light guide 30 from being illuminated when the button body 14 has not been depressed to activate the feature controlled by the push button 10. As a result, the operator will not receive a false indication that the feature controlled by the push button 10 has been activated. Furthermore, the reflector 12, button body 14, and links 16 are advantageously molded as a single, monolithic piece by a one-shot injection molding process, which is in contrast to the prior art push button 110, which requires a two-shot or two-piece molding process. The one-shot injection molding process of the present disclosure advantageously reduces manufacturing costs and time. One skilled in the art will appreciate that the present disclosure provides numerous additional advantages and unexpected results over the art.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A method of manufacturing a push button for a control panel comprising:

molding as a single, monolithic piece a reflector, a button body, and links extending between the reflector and the button body;

inserting an indicator light guide within the button body;

mounting the reflector to a circuit board including a tact switch, a first light source that illuminates a graphic on a button cap seated on the button body, and a second light source that illuminates the indicator light guide; and mounting the reflector to the circuit board such that a divider of the button body is between the first light source and the indicator light guide to restrict light from the first light source from illuminating the indicator light guide.

2. The method of claim 1, wherein the molding is one-shot, injection compression molding.

3. The method of claim 1, wherein:

the molding further includes molding the button body with guiderails that extend from sidewalls of the button body to contact the reflector and maintain the button body centered within the reflector; and the reflector and button body are molded such that the reflector surrounds the button body.

4. The method of claim 1, wherein the links are flexible polymeric strips.

5. The method of claim 1, wherein the links are rigid polymeric bridges that are severed subsequent to the molding.

6. The method of claim 1, wherein the links are molded to extend linearly between the reflector and the button body.

7. The method of claim 1, wherein the links are molded to extend non-linearly between the reflector and the button body.

8. The method of claim 1, wherein the molding of the links includes molding a first plurality of links in a first plane and a second plurality of links in a second plane that is linearly offset from the first plane.

9. A push button for a control panel comprising:

a circuit board including a tact switch, a first light source, and a second light source;

a reflector mounted to the circuit board;

a button body arranged over the first light source, the second light source, and the tact switch such that actuation of the button body actuates the tact switch;

an indicator light guide within the button body arranged over the second light source for the second light source to illuminate the indicator light guide;

a cap on the button body, the cap including a graphic illuminated by the first light source, the indicator light guide is visible at an exterior surface of the cap offset from the graphic when illuminated by the second light source; and a divider of the button body between the first light source and the indicator light guide to restrict light from the first light source from illuminating the indicator light guide;

wherein the button body and the reflector are molded as a single, monolithic piece with links extending between the button body and the reflector.

10. The push button of claim 9, wherein the links are flexible.

11. The push button of claim 10, wherein the links are each linear.

12. The push button of claim 10, wherein the links are each non-linear.

13. The push button of claim 12, wherein the links include first flexible links and second flexible links, the first flexible links are vertically offset from the second flexible links.

14. The push button of claim 9, further comprising guiderails extending from the button body to center the button body within the reflector;

wherein the button body is surrounded by the reflector.

15. The push button of claim 9, wherein the button body, the reflector, and the links are molded by injection compression molding.

16. The push button of claim 9, wherein upon depressing the button body the links connecting the button body to the reflector flex and the button body depresses the tact switch.

17. The push button of claim 9, wherein the links are molded as rigid links that are severed after molding.

18. The push button of claim 9, wherein the first light source and the second light source are each light emitting diodes.

19. The method of claim 1, wherein the links are bridges of molding material formed in an area of a mold providing a passageway between the reflector and the button body during molding to allow the push button to be molded as the single, monolithic piece.

20. The push button of claim 9, wherein the links are bridges of molding material formed in an area of a mold providing a passageway between the reflector and the button body during molding to allow the push button to be molded as the single, monolithic piece.

* * * * *